United States Patent [19]

Tichy et al.

[11] Patent Number: 4,788,910

[45] Date of Patent: Dec. 6, 1988

[54] PRESS FOR EXTRACTING JUICE FROM COMESTIBLE SOLIDS AND SEMI-SOLIDS SUCH AS FRUITS AND VEGETABLES

[75] Inventors: Oldrich J. Tichy, Concord; Konrad E. Meissner, Lafayette, both of Calif.

[73] Assignee: Atlas Pacific Engineering Company, Pueblo, Colo.

[21] Appl. No.: 514,099

[22] Filed: Jul. 15, 1983

Related U.S. Application Data

[63] Continuation-in-part of Ser. No. 509,865, Jun. 30, 1983, abandoned.

[51] Int. Cl.[4] ..... B30B 9/24

[52] U.S. Cl. ..... 100/120; 100/152; 100/211; 100/286

[58] Field of Search ..... 100/118, 119, 120, 152, 100/211, 269 A, 269 B, 286; 198/531

[56] References Cited

U.S. PATENT DOCUMENTS

| | | | |
|---|---|---|---|
| 100,607 | 3/1870 | Curtis | 100/286 |
| 753,696 | 3/1904 | Geiger | 100/152 |
| 2,353,760 | 7/1944 | Richards | 100/211 X |
| 2,414,053 | 1/1947 | McCarthy | 100/211 X |
| 2,637,434 | 5/1953 | Harper | 198/531 X |
| 2,865,286 | 12/1958 | Wacht | 100/288 X |
| 3,098,429 | 7/1963 | Hagglund | 100/211 X |
| 3,816,052 | 6/1974 | Schoppee et al. | 74/109 X |
| 3,825,382 | 7/1974 | Davidson | 100/211 |
| 3,964,958 | 6/1976 | Johnston | 100/211 X |
| 3,992,298 | 11/1976 | Davis | 100/118 X |
| 4,013,003 | 3/1977 | Finsterwalder et al. | 100/286 X |
| 4,028,166 | 6/1977 | Leonhart | 100/211 X |
| 4,078,962 | 3/1978 | Krueger | 100/211 X |
| 4,152,188 | 5/1979 | Friedrich et al. | 100/211 X |
| 4,396,451 | 8/1983 | Yeager | 100/211 X |
| 4,406,726 | 9/1983 | Lisec | 100/288 X |

FOREIGN PATENT DOCUMENTS

| | | | |
|---|---|---|---|
| 1254571 | 11/1967 | Fed. Rep. of Germany | 100/211 |
| 1204824 | 1/1960 | France | 100/211 |

*Primary Examiner*—Harvey C. Hornsby
*Assistant Examiner*—Frankie L. Stinson

[57] ABSTRACT

A press for extracting juice from comestible solids and semi-solids such as fruit and vegetables which includes a stationary perforated platen, a juice pervious conveyor belt for carrying comminuted comestible into pressing position over that platen, a feeder for forming a series of separated non-continuous beds of comminuted comestible upon the belt, a rotary drive moving the belt incrementally to position each bed of comestible in sequence over the stationary platen and a pressing platen which has a pressing cavity overlying the stationary platen defined by a depending sealing flange circumscribing the bed of comestible and a flexible membrane within the cavity that can be expanded into pressing engagement with the bed by pneumatic pressure in order to press juice from the comestible for drainage through the juice pervious belt and perforated stationary platen into a juice collection pan.

4 Claims, 8 Drawing Sheets

PRESS FOR EXTRACTING JUICE FROM COMESTIBLE SOLIDS AND SEMI-SOLIDS SUCH AS FRUITS AND VEGETABLES

This application is a continuation-in-part of application Ser. No. 509,865 filed June 30, 1983 and now abandoned, entitled "Press For Extracting Juice from Comestible Solids and Semi-Solids such as Fruits and Vegetables."

BACKGROUND OF THE INVENTION

Heretofore fruits and vegetables or a pulp made from them have been physically pressed between fixed platens or a fixed platen and an expandable pneumatic press bag to squeeze juice from the fruit, vegetable or pulp. The article entitled "Automatic Pneumatic Press" appearing at page 31 of *Vines and Wines,* Dec., 1960, describes such a press having fixed platens and an expandable pneumatic press bag to press juice from a continuous bed of comestible that is carried between the platens by a conveyor belt.

BRIEF DESCRIPTION OF THE INVENTION

This invention is a press which includes a movable pressing platen for circumscribing and pressing by means of an expandable, flexible membrane, a non-continuous bed of comestible conveyed over a fixed perforated platen by a juice pervious belt.

A principal object of the invention is a juice extraction press of modular design which can be one of a series operating at different pressing pressures to practice the process disclosed and claimed in co-pending application Ser. No. 406,088 filed Aug. 6, 1982, by Oldrich J. Tichy and Konrad E. Meissner entitled "Pressing Method for Extracting Liquid from Comestibles such as Fruits and Vegetables."

Another object of the invention is to provide a press that employs an inexpensive expandable flat membrane, rather than a more complex and expensive pneumatic bag as the active pressing means.

One other object of the invention is to provide a movable pressing platen that carries the expandable membrane within a pressing cavity that is defined by the membrane and by a seal flange that circumscribes a non-continuous bed of comestible during the pressing operation.

Still another object of the invention is a feeder which gates onto the conveyor belt, a non-continuous bed of comestible equivalent in top surface area to the pressing area of the membrane.

Other objects and advantages of the invention will become apparent upon consideration of the following description of a preferred embodiment of the press and of the accompanying drawings.

DESCRIPTION OF A PREFERRED EMBODIMENT

Figure 1:
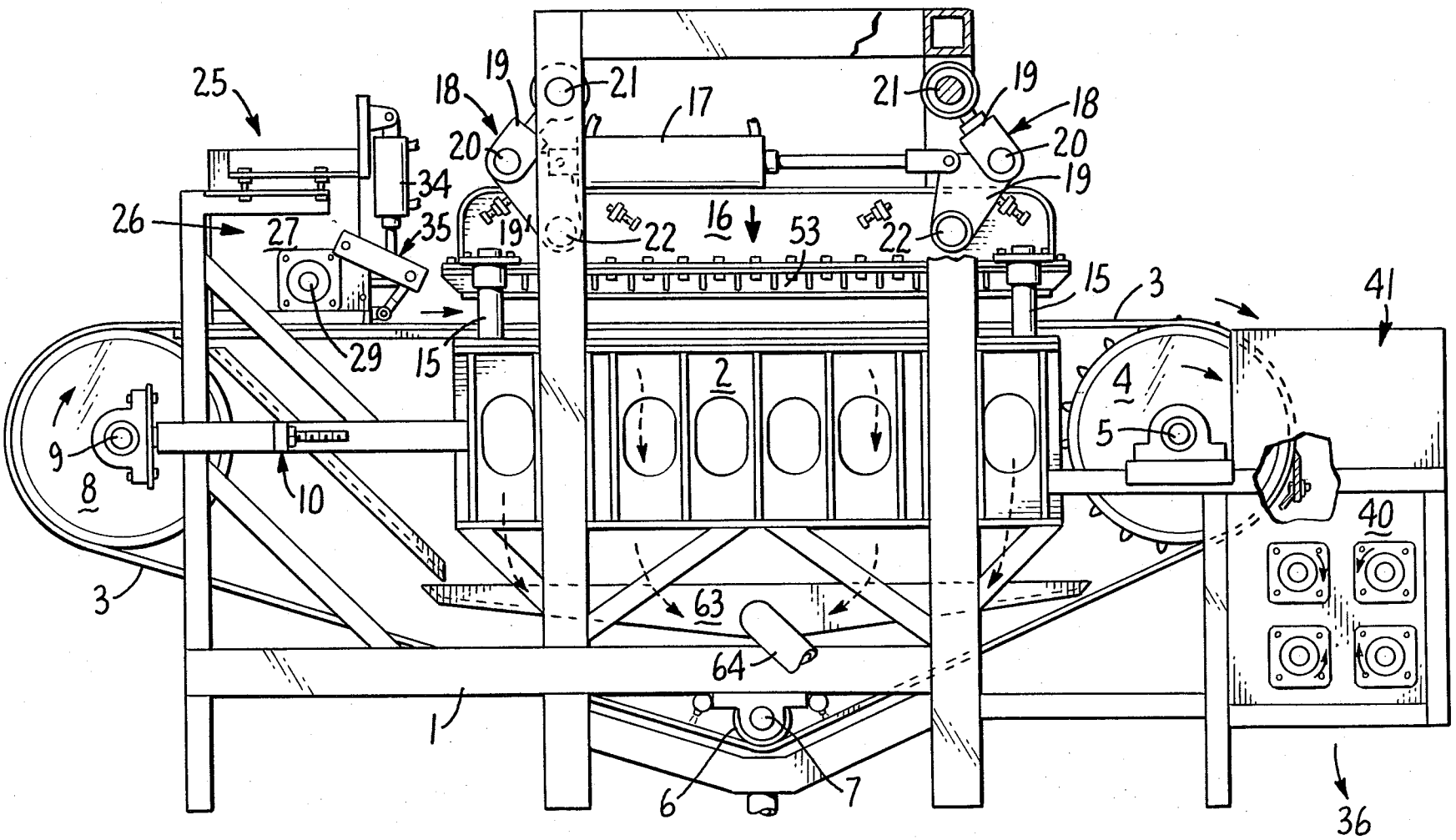
FIG. 1 is a side elevational view of the press.

The press includes a rigid frame referred to generally as 1 upon which mounts a stationary perforated platen referred to generally as 2. A juice pervious conveyor belt 3 travels over the stationary platen 2 in the direction of the arrows shown on FIG. 1. The belt 3 trains over toothed drive drum 4 mounted on the frame in journal bearings 5, smooth surfaced idler roll 6 journaled in bearings 7 also mounted upon the frame and a toothed take-up idler drum 8 mounted in journal bearings 9 adjustably mounted to the frame by means of a pair of take-up nut and bolts referred to at 10.

Also mounted on the frame 1 and slidable on four guide posts 15 is a movable pressing platen referred to generally as 16. The pressing platen 16 overlies the conveyor belt 3 and its underlying stationary platen 2. It is movable vertically by a pair of hydraulic cylinders 17 each of which actuate a pair of scissor mechanisms 18 at each end of the pressing platen. The scissor mechanisms each comprise a pair of links 19 pinned together on the axis of cylinder 17 at 20 with one link of each pair pinned at 21 to the frame 1 and the other link pinned at 22 to the movable pressing platen 16, itself. The uppermost position of the pressing platen 16 is shown in FIGS. 1, 3 and 4. Its lowermost position is shown in FIG. 5.

Comminuted comestible material for pressing flows at 25 into a feeder referred to generally as 26 overlying the conveyor belt 3 between the take-up drum 8 and the platens 2, 16. Comestible material distributes into feeder 26 from an oscillating conveyor or other means, not shown. The feeder 26 includes a hopper 27 with a gated opening 28 shown in FIG. 3 through which comestible discharges in a bed 30 upon the moving conveyor belt 3 traveling in the direction of the arrows in FIGS. 1 and 3. Feeder rotor 29 having a plurality of straight rods 31 driven by gearhead motor 32 moves comestible material to the gate opening 28 and out onto the traveling belt 3. A slidable gate door 33 manipulated by hydraulic cylinder 34 and a pivoted linkage referred to generally as 35 moves the gate door 33 upwardly to provide the gate opening 28 and moves the gate door downwardly to close it. The lower edge of the gate door 33 controls the height of the bed 30 of comestible that deposits upon the belt. This height may be adjusted by controlling the stroke of the cylinder 34 or linkage 35.

Figure 2:
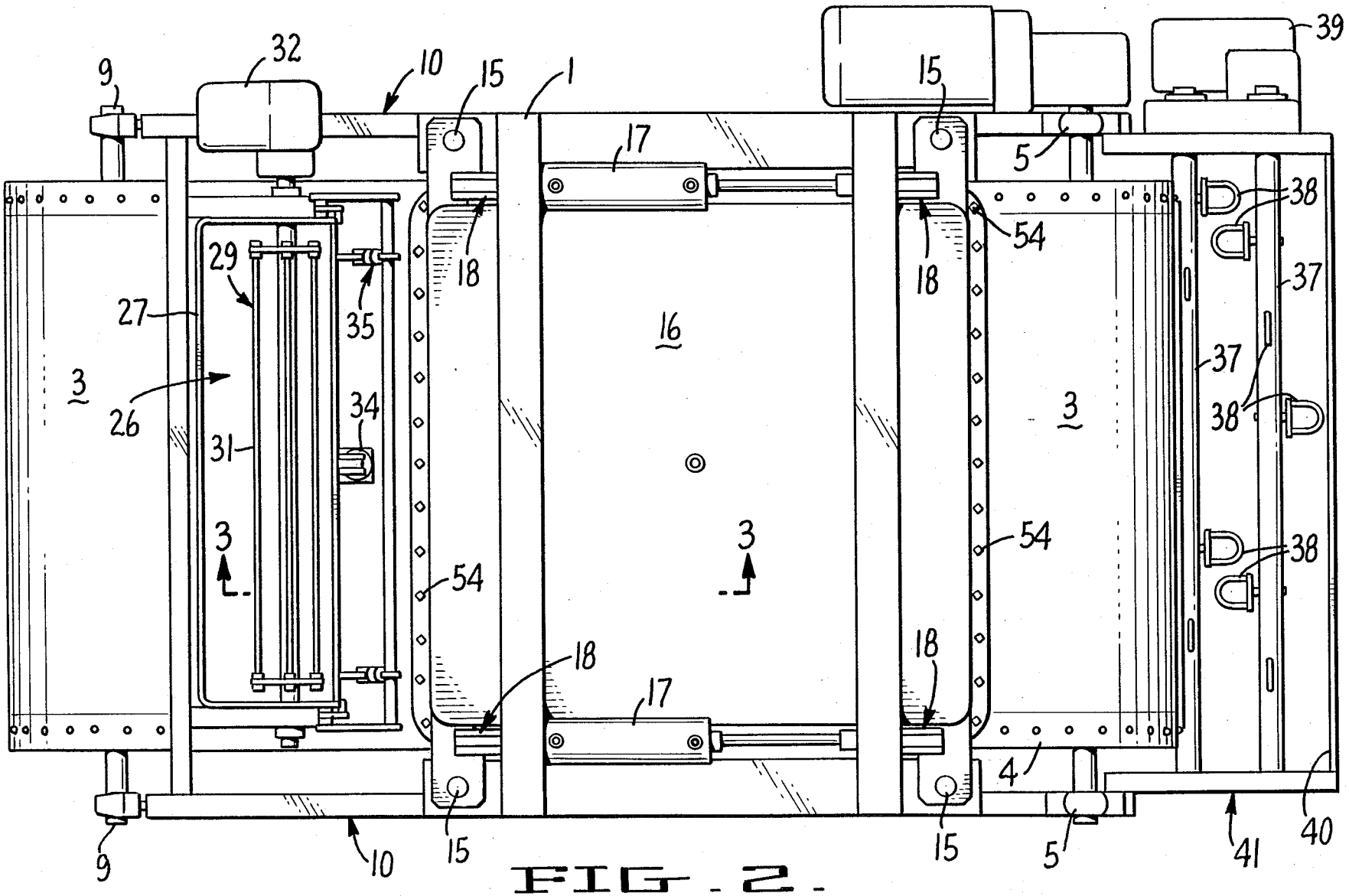
FIG. 2 is a top plan view of the press.
Figures 3, 4, 5:
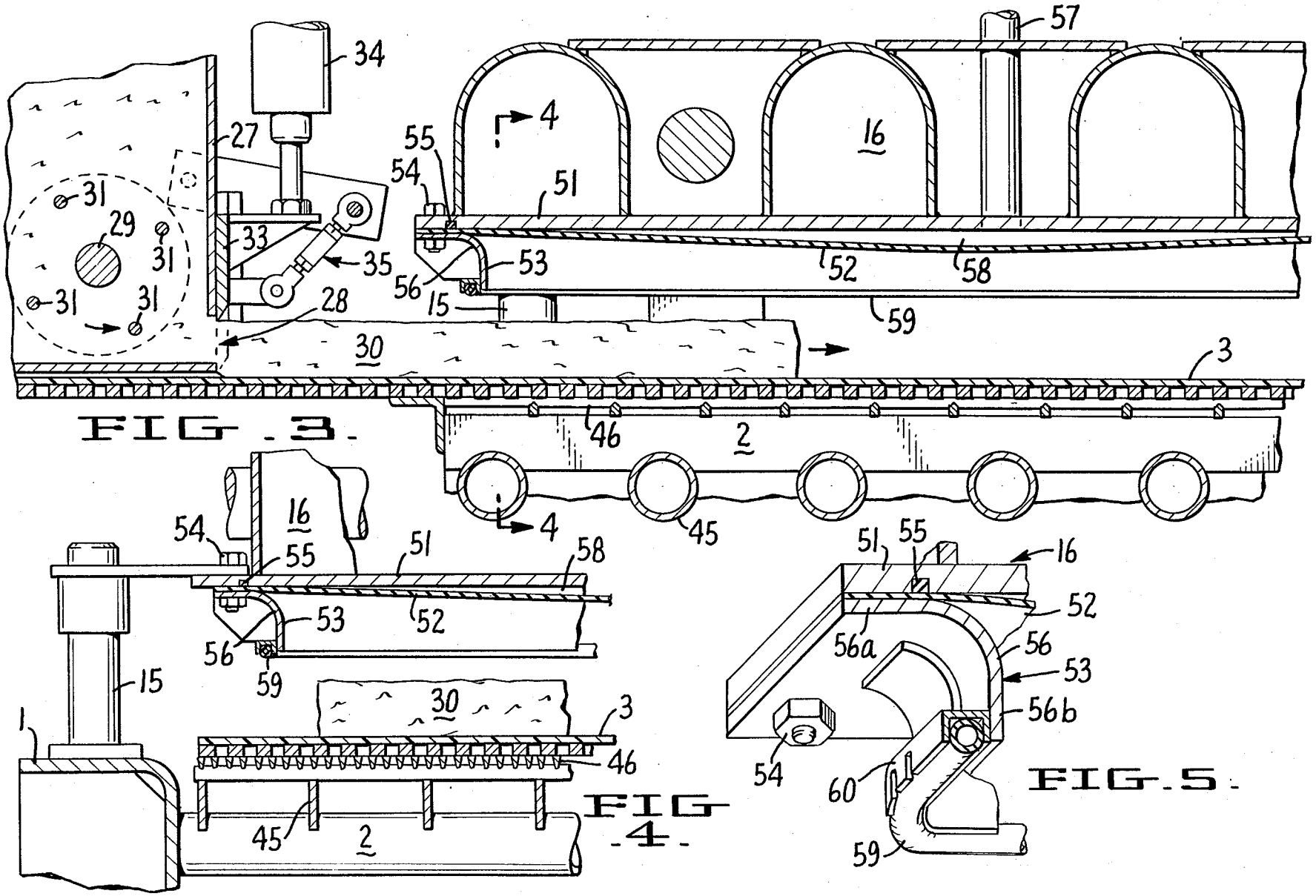
FIG. 3 is a partial vertical sectional view through the feeder and a portion of the belt and platens taken along line 3—3 of the FIG. 2.
FIG. 4 is an enlarged vertical sectional view of the belt and platens taken along line 4—4 of FIG. 3.
FIG. 5 is a partial perspective view partly in section of the depending sealing flange of the movable platen.
Figure 6:
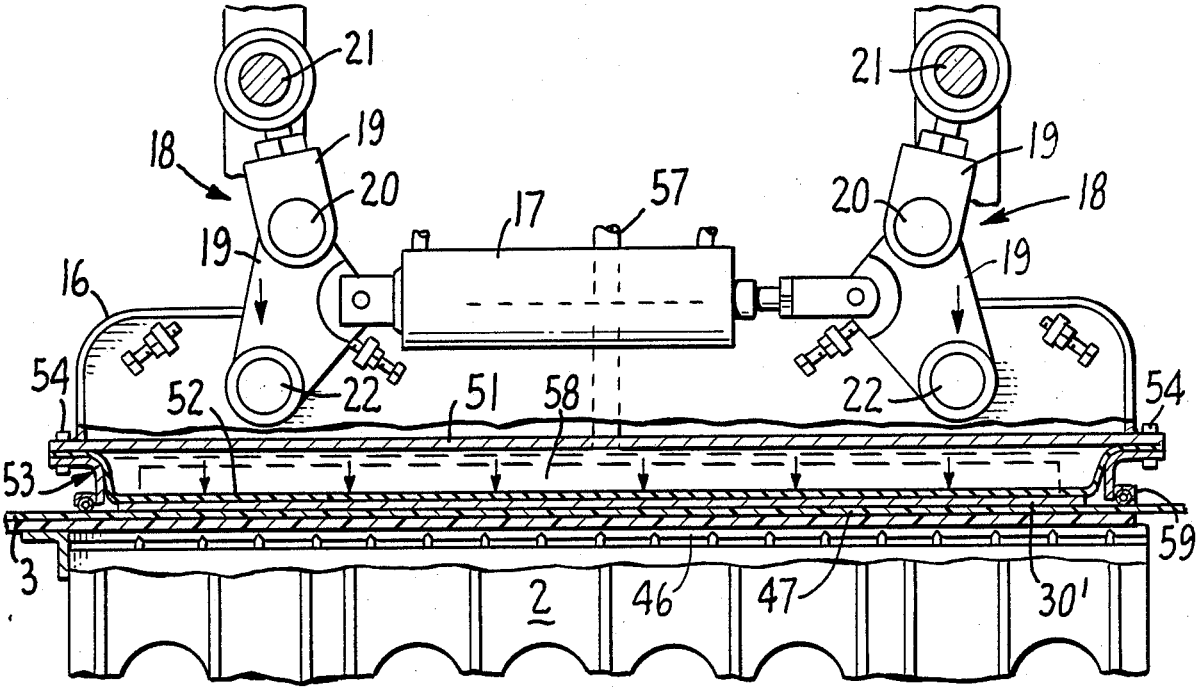
FIG. 6 illustrates one form of lift mechanism for the movable platen in side elevation partly in section.
Figure 8:
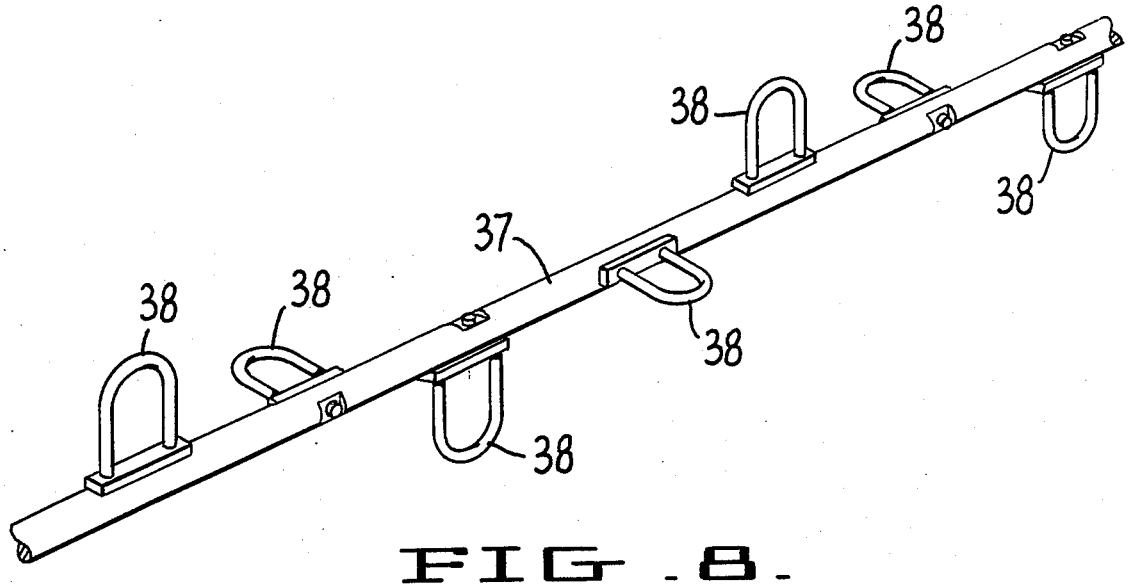
FIG. 8 illustrates the mixer bar and paddle construction.

A multiple paddle mixer 41 at the discharge end of the belt 3 shown in FIGS. 1 and 2 receives the pressed comestible cake 30' shown in FIG. 5 and breaks it back into particles for discharge through the open bottom at 36 into subsequent processing stages such as those illustrated in co-pending application Ser. No. 406,088 filed Aug. 6, 1982, by Oldrich J. Tichy and Konrad E. Meissner entitled "Pressing Method for Extracting Liquids from Comestibles such as Fruits and Vegetables". This mixer 41 in the described embodiment as more clearly is illustrated in FIGS. 2 and 8 comprises four paddle rods 37 carrying spaced paddles 38 that are continuously rotated from a common drive motor 39 in counter-rotating directions within the mixer hopper 40.

Figure 7:
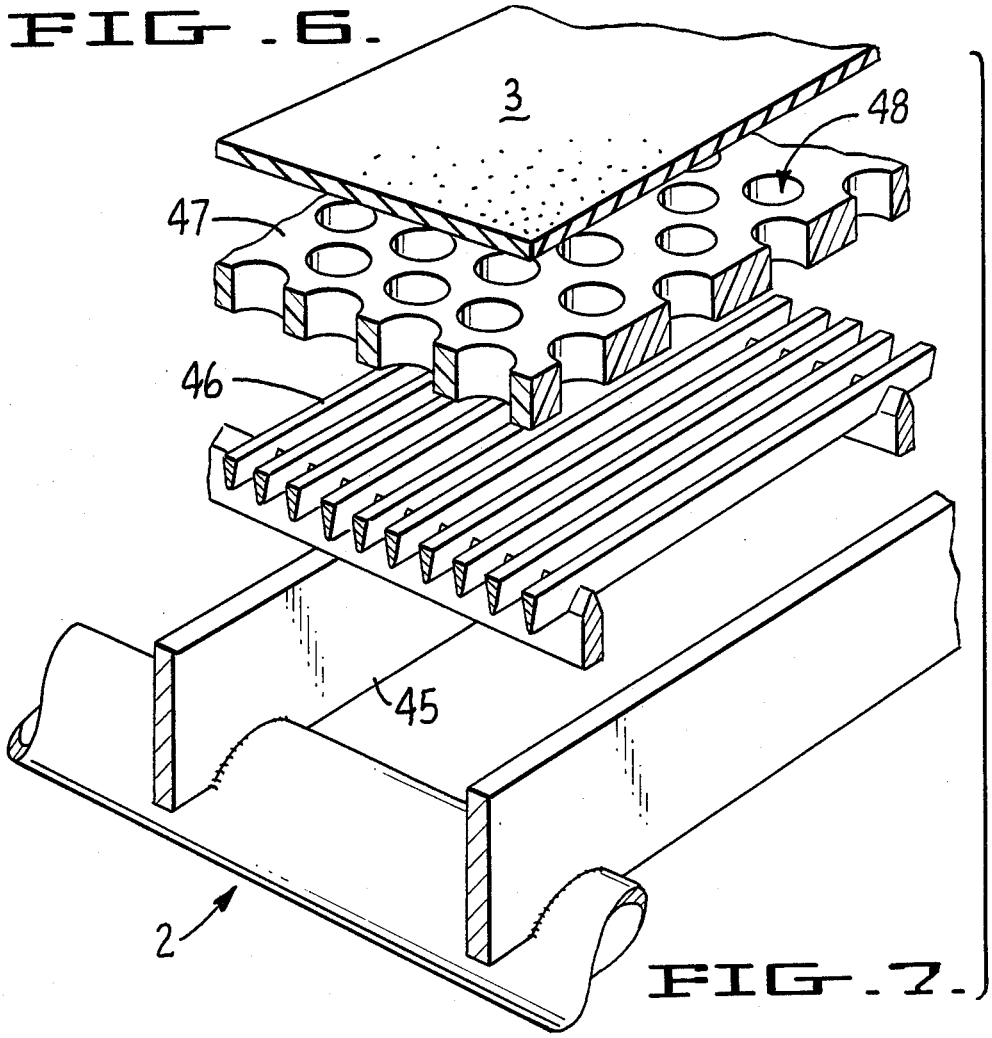
FIG. 7 is an exploded view of the fixed platen construction and a portion of the overlying conveyor belt.

As illustrated, the stationary platen 2 is a rigid weldment fabricated from structural steel members and stiffened to withstand the pressing forces that are exerted upon it. Overlying the structural steel members illustrated in the exploded view of FIG. 7 and in FIG. 3 generally as 45 is a grid of closely spaced bars 46 arranged longitudinally with respect to the belt travel. These stainless steel bars 46 rest upon the structural steel members 45 of the stationary platen 2. Overlying the bars 46 is a sheet of ultra-high molecular weight polyethylene or similar material, perforated with approximately ½ inch diameter holes so its surface area is about 50% open. The juice pervious belt 3 in the described embodiment may be made from metal or plastic mesh. In the described embodiment the belt has open spaces or perforations in the range of 0.020–0.030 inches in diameter.

The movable pressing platen 16 in the described embodiment also is a weldment fabricated from structural steel members as is more clearly shown in FIGS. 3, 4 and 5. The structural steel members stiffen the pressing platen face plate 51 which has secured to its lower surface the expandable pressing membrane 52 by means of depending sealing flange 53 secured to the face plate 51 around its periphery by a plurality of nuts and bolts 54 to hold the membrane securely between face plate 51 and sealing flange 53. The membrane is flat rubber sheet. The sealing flange 53 and membrane 52 define a pressing cavity which, with belt 3, completely encloses each separated bed 30 of comestible as it is pressed. The sealing flange has a curved radius 56 connecting horizontal leg **56*a* through which bolts 54 pass and depending vertical leg 56*b*. The flexible membrane deflects around radius 56 as it expands into the pressing position shown in FIG. 5**.

An air-tight seal between the flexible pressing membrane 52 and platen face plate 51 is formed around the flange periphery by a hard rubber gasket 55 carried in a groove formed in face plate 51 and pressed beneath sealing flange horizontal leg **56*a*. Air under pressure is communicated through a central conduit 57 to the space 58, shown in FIG. 3, between platen face plate 51 and membrane 52 to expand the pressing membrane within the pressing cavity into pressing engagement with the comestible bed 30. In the described embodiment, air pressures in the range of 20 to 90 psi gauge pressure are used. The lower end of leg 56*b* of the sealing flange 53 carries a continuous resilient rubber seal 59 retained in a channel 60. The seal 59 is approximately 2 inches below the platen face plate 51 in the described embodiment for pressing a bed 30 of comestible gated out of the feeder 26** at approximately 2 inches in height.

Comestible to be pressed is moved from the feeder 26 by its rotor bars 31 that continuously move at the same peripheral velocity as the conveyor belt 3 during the feeding operation. Gate door 33 in its upward retracted position shown in FIG. 3 opens the gate opening 28 and controls the height of the comestible bed 30 as the rotor spreads the comminuted comestible on the traveling belt. In the described embodiment, the rotor bar peripheral velocity and the belt velocity are about 6 inches per second.

Figure 9:
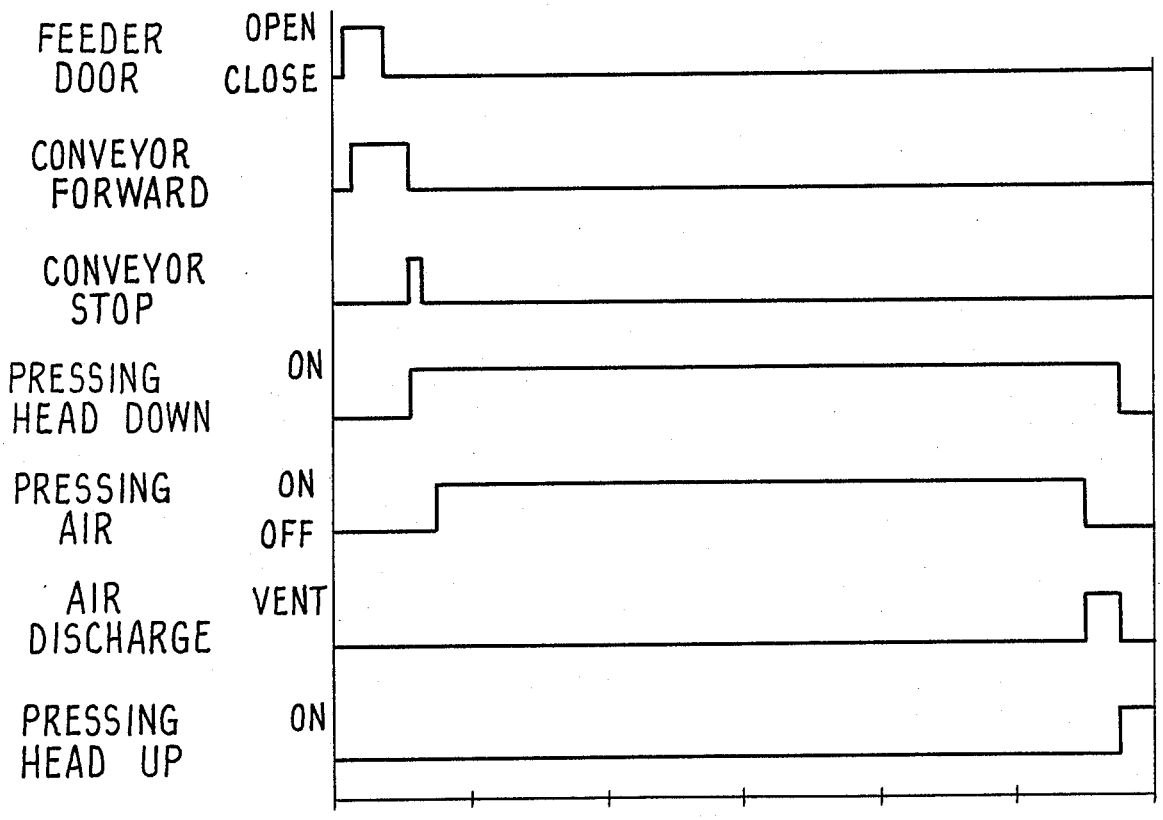
FIG. 9 illustrates the timing sequence of the various parts of the press.

FIG. 9 illustrates the timed relationship of the various press components. In sequence, the feeder door 33 opens and simultaneously the conveyor belt 3 commences its forward travel until a bed 30 of comestible is laid upon the belt which approximates the length of the movable pressing platen 16 in the direction of belt travel. The feeder door 33 then closes but conveyor belt 3 moves forward until the non-continuous bed 30 is directly below the movable pressing platen 16 and over the stationary platen 2 at which time belt travel stops. The pressing platen 16 moves downwardly into the pressing position shown in FIG. 5. Shortly after the pressing platen starts its downward travel, pneumatic pressure is admitted through conduit 57 to expand the flexible membrane 52 into pressing engagement with the bed 30 which then is completely enclosed within the pressing cavity formed by the membrane and the depending flange 53 that circumscribes the bed and with seal 59 pressed against the belt 30. The flexible membrane expands against the comestible bed as shown in FIG. 5 to compress it into a tightly packed cake 30' and express the juice through the pervious belt, perforated plastic sheet 47, 48 and grid bars 46 into collecting pan 63 which underlies the open structure of the stationary perforated platen 2. The expressed juice is conveyed away for further processing through conduit 64.

At the end of the pressing operation shown in FIG. 5, the pressure in the space 58 between platen face plate 51 and flexible membrane 52 vents to atmosphere and the pressing platen 16 then moves upwardly with approximately a 4 inch travel to the position shown in FIG. 3. The foregoing feeder operation then repeats, while the pressed cake 30' moves off the belt into mixer 41 and a new bed is spread upon the belt by feeder 26. Mixer 41 breaks up the pressed cake 30' into particulate form for further processing in accord with the procedure outlined in the co-pending application Ser. No. 406,088 mentioned above.

Figure 12:
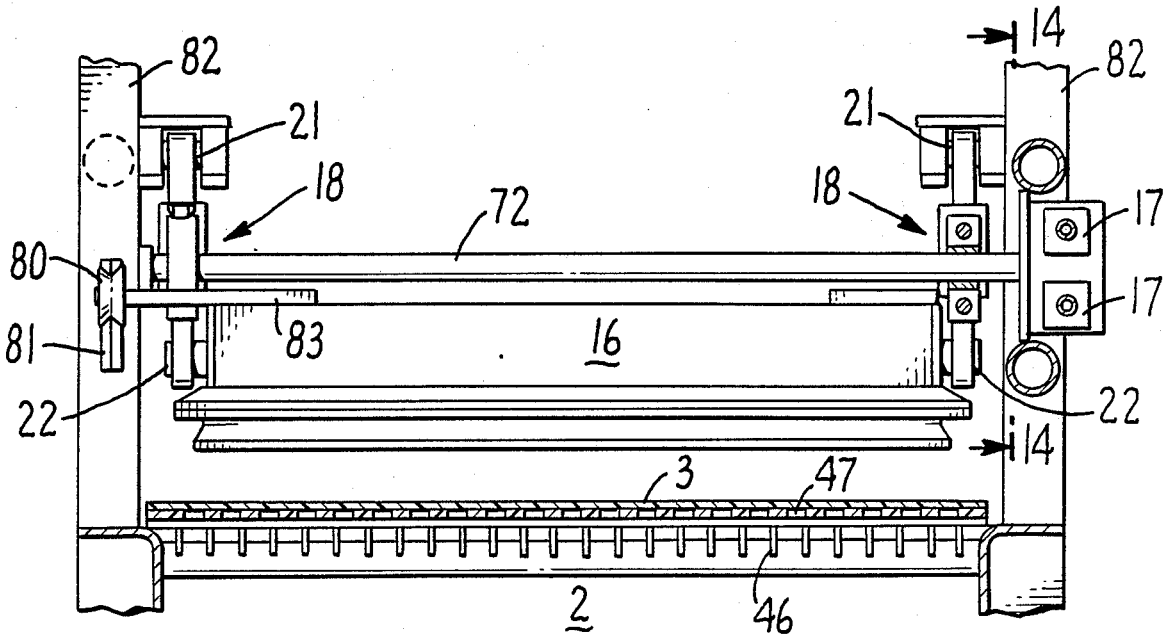
FIG. 12 is an elevational view of the pressing platen partially in section taken along line 12—12 of FIG. 10.
Figure 13:
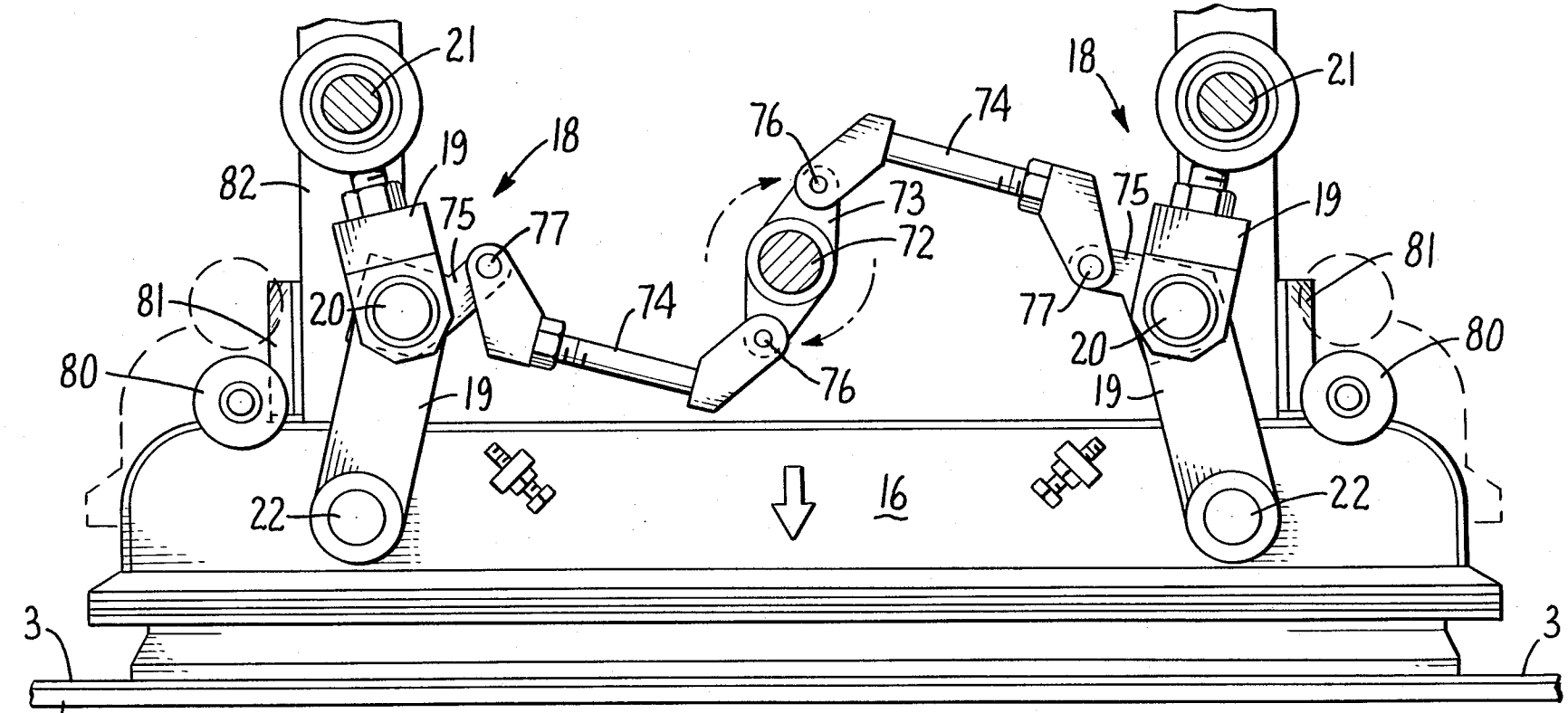
FIG. 13 is an enlarged elevational view of the modified means for raising and lowering the pressing platen shown in FIG. 10.
Figure 14:
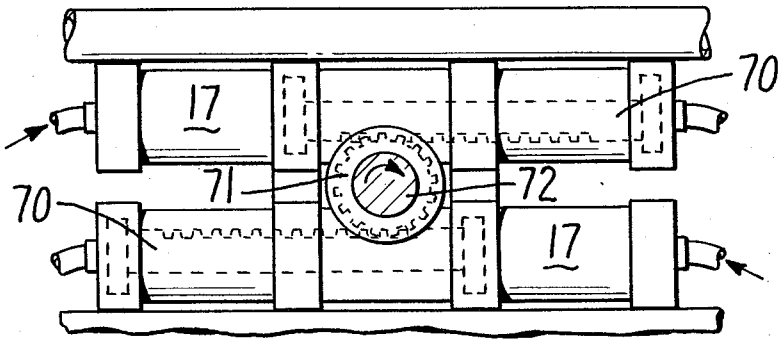
FIG. 14 is a side elevational view of the rack and pinion drive cylinders for the pressing platen taken along lines 14—14 of FIG. 12.

FIGS. 10 and 12–14 illustrate an alternative drive mechanism for raising and lowering the pressing platen 16. As illustrated in FIGS. 10, and 12–14 a pair of hydraulic cylinders 17 mounted at one side of the frame 1, as shown in FIG. 12, actuate scissor mechanisms 18 at each corner of the pressing platen. The illustrated scissor mechanisms also each comprise a pair of links 19 pinned together at 20 with one link of each pair pinned at 21 to the frame 1 and the other link pinned at 22 to the movable pressing platen 16, itself. However, in this embodiment, each of cylinders 17 drives a piston mounted rack 70 in opposite directions to rotate rack pinion 71 mounted on drive shaft 72. The drive shaft 72 by means of crank 73 and links 74 each pinned at one end to crank 73 and at the other end to crank 75 by pins 76, 77, respectively, simultaneously actuates all four of the scissors mechanism 18 to induce the scissoring action that moves the pressing platen 16 from its upper position shown in FIG. 10 to the lower position shown in FIG. 13. The pressing platen 16 tracks vertically upon the press frame 1 by means of four V-grooved rolls 80 that roll upon V-shaped tracks 81 mounted on frame vertical elements 82. The V-grooved rolls 80 mount in pairs upon shafts 83 at each end of the pressing platen 16.

Figure 10:
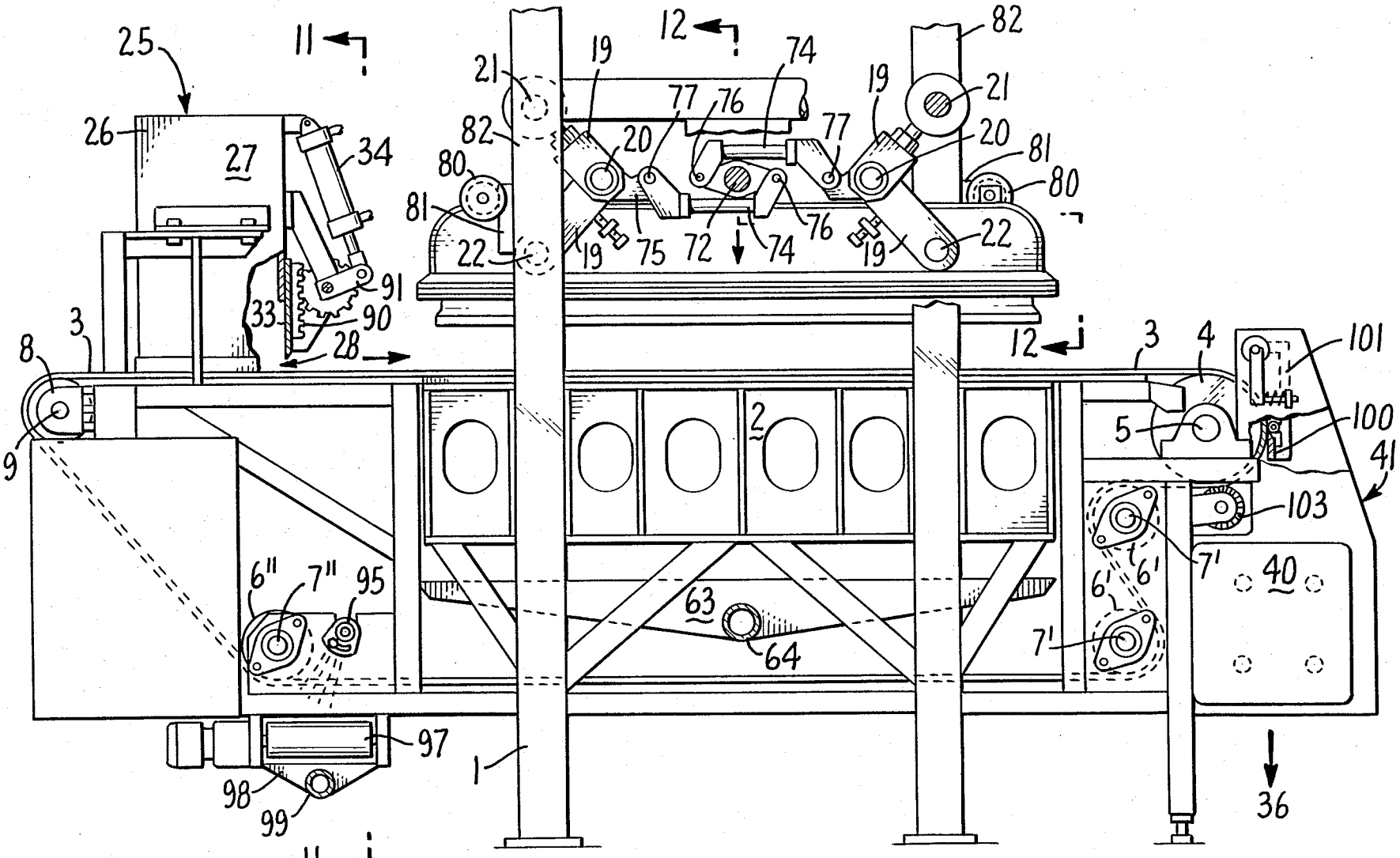
FIG. 10 is a side elevational view of the press having a rack and pinion drive means for raising and lowering the pressing platen and the slidable gate door.
Figure 11:
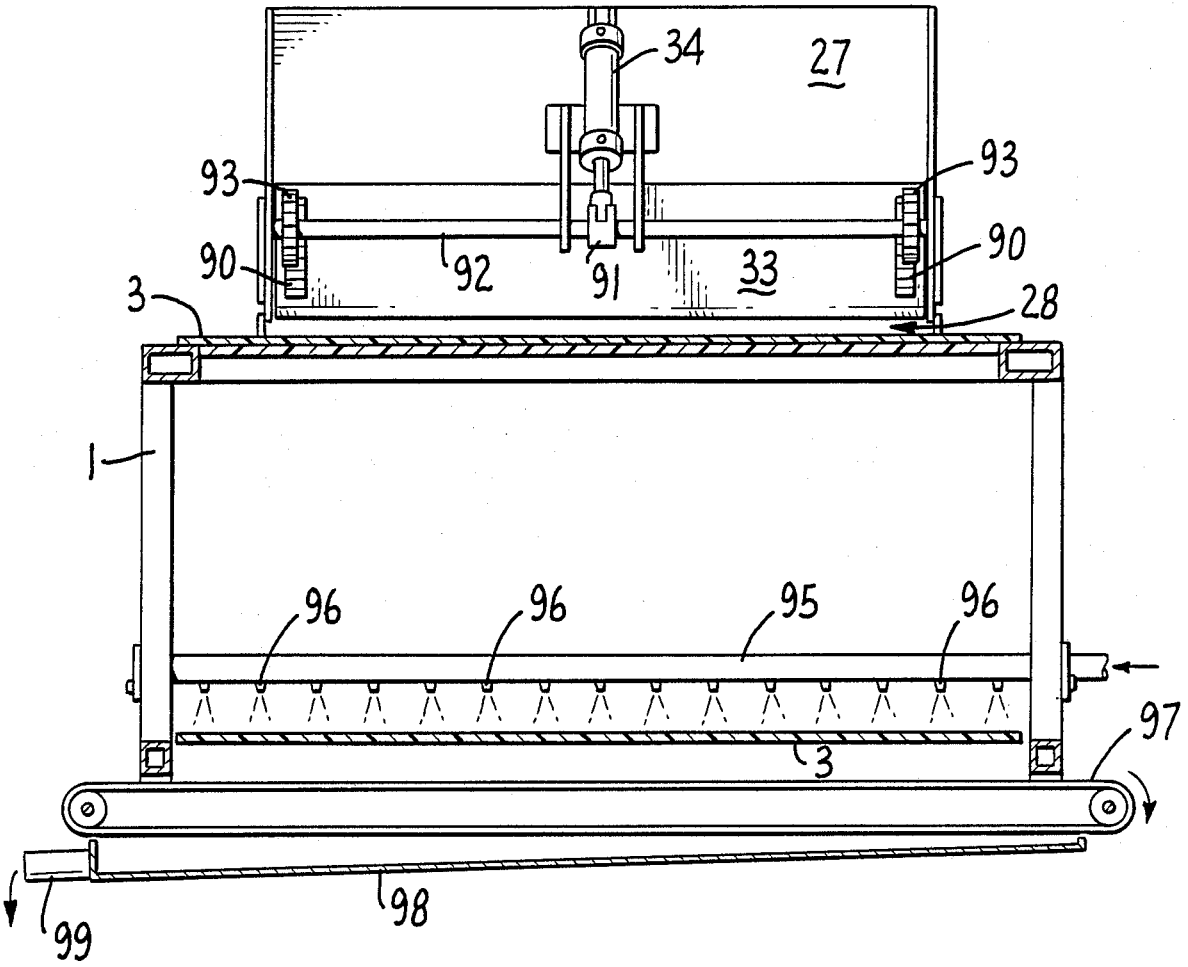
FIG. 11 is a vertical sectional view of the press along lines 11—11 of FIG. 10 illustrating the modified gate door drive and belt cleaning aspects of the invention.

The gated opening 28 of the feeder hopper 27 in the embodiment of FIGS. 10–11 is raised and lowered also by racks 90 mounted on the gate door 33. Hydraulic cylinder 34 through crank 91 rotates shaft 92 carrying a pinion 93 at each end to drive the racks 90 and thereby raise and lower the gate door 33, to control gated opening 28 as described in connection with the version shown in FIGS. 1–3.

In the embodiment of FIG. 10 the single idler roll 6 and its journal bearings 7 are replaced by three sets of idler rolls 6', 6'' at their journal bearings 7', 7''. Just prior to training over idler 6'' the belt 3 is exposed to a pressured water spray distributed across its width by distributor pipe 95 carrying a series of nozzles 96. Comestible debris washed off of the load-carrying side of the belt 3 drops onto the cross conveyor 97 for disposal or recycle. The wash water drains into basin 98 for disposal through conduit 99.

In the embodiment illustrated in FIG. 10, the pressed comestible cake is removed from the belt 3 by a spring biased doctor blade 100 pressed into resilient engagement with the belt over the mixer hopper 40 by a spring loaded lever means shown generally as 101 pivoted from the mixer hopper 40. Adjacent to the doctor blade 100 a rotary brush 103 also overlying the mixer hopper 40 further mechanically cleans comestible material from the belt 3.

The foregoing embodiments and their modes of operation are described for illustrative purposes only. Various modifications will be apparent to those familiar with the pertinent press technology within the scope of the invention defined in the following claims.

We claim:

1. In a press for extracting juice from comestible solids and semi-solids such as fruits and vegetables having a stationary perforated platen, a pressing platen moveable into pressing relation to the stationary platen, a juice pervious belt for carrying comestible, feeder means for feeding and depositing a non-continuous bed of comestible upon said belt for pressing, and means for moving the belt incrementally to position one segment of the bed of comestible over the stationary platen, the improvement comprising:

said pressing platen having mounted thereto and movable therewith a flexible membrane and a depending sealing flange for circumscribing one segment of the bed of comestible positioned over said stationary platen, said flexible membrane overlying the one segment of said bed and being expandable into pressing engagement with the bed;

means for moving said pressing platen to place said sealing flange into sealing engagement with the belt and circumscribing the bed of comestible; and pressure means for expanding said flexible membrane into pressing engagement with said bed to press the juice from the comestible for drainage through the perforated stationary platen and juice pervious belt.

2. The press of claim 1 wherein the pressing platen has a rigid face plate adjacent to the flexible membrane and the sealing flange that seals the periphery of the membrane to the face plate and sealing flange in airtight seals.

3. The press of claim 2 wherein the pressure means admits air under pressure to the space between the face plate and flexible membrane during pressing and otherwise vents the space to atmosphere.

4. The press of claim 1, said means for moving said pressing platen and sealing flange into sealing engagement with the belt comprising a scissor mechanism mounted at each corner of the pressing platen and pinned to the pressing platen and to a press frame; at least one hydraulically driven rack mounted on said press frame, a rack pinion actuated by the rack and carrying a drive shaft; crank and link means mounted on the drive shaft and interconnecting each of said scissors mechanisms for inducing scissoring action in response to transverse motion of said rack.

* * * * *